US009950355B2

(12) United States Patent
Lin et al.

(10) Patent No.: US 9,950,355 B2
(45) Date of Patent: Apr. 24, 2018

(54) METHOD OF FORMING A COMPONENT OF COMPLEX SHAPE FROM SHEET MATERIAL

(75) Inventors: Jianguo Lin, London (GB); Daniel Balint, London (GB); Lilang Wang, London (GB); Trevor Anthony Dean, West Midlands (GB); Alistair David Foster, Worcester (GB)

(73) Assignee: Imperial Innovations Limited, South Kensington (GB)

( * ) Notice: Subject to any disclaimer, the term of this patent is extended or adjusted under 35 U.S.C. 154(b) by 489 days.

(21) Appl. No.: 13/509,364

(22) PCT Filed: Nov. 15, 2010

(86) PCT No.: PCT/GB2010/002100

§ 371 (c)(1),
(2), (4) Date: Oct. 1, 2012

(87) PCT Pub. No.: WO2011/058332

PCT Pub. Date: May 19, 2011

(65) Prior Publication Data

US 2013/0125606 A1 May 23, 2013

(30) Foreign Application Priority Data

Nov. 13, 2009 (GB) ..... 0919945.6

(51) Int. Cl.
*B21D 21/00* (2006.01)
*C22C 21/00* (2006.01)
(Continued)

(52) U.S. Cl.
CPC ..... *B21D 21/00* (2013.01); *C22C 21/00* (2013.01); *C22C 21/06* (2013.01); *C22C 21/08* (2013.01);
(Continued)

(58) Field of Classification Search
CPC . C22F 1/04; C22F 1/047; C22F 1/057; C21D 1/673; C21D 9/46; B21D 21/00
(Continued)

(56) References Cited

U.S. PATENT DOCUMENTS 1,751,500 A * 3/1930 Winter ..... C22F 1/04 148/694
3,568,491 A 3/1971 Bruner et al.
(Continued)

FOREIGN PATENT DOCUMENTS

WO 2008059242 A2 5/2008
WO 2008059242 A3 5/2008
WO 2009130175 A1 10/2009

OTHER PUBLICATIONS

AZO Materials, Aluminum/Aluminum 2024 Alloy (UNSA92024), Aug. 30, 2012, www.azom.com/article.aspx?ArticleID=6615.*
(Continued)

*Primary Examiner* — R. K. Arundale
*Assistant Examiner* — Pradeep C Battula
(74) *Attorney, Agent, or Firm* — Dorsey & Whitney LLP

(57) ABSTRACT

Method of forming a component of complex shape from an Al-alloy sheet or a Mg-alloy sheet. The method includes the steps of: a) heating the sheet to a temperature below the solution heat treatment (SHT) temperature for the alloy; b) forming the heated sheet between heated dies into or towards the complex shape; c) heating the sheet to at least its SHT temperature and substantially maintaining that temperature until SHT has been completed; and d) quenching the solution heat treated sheet between cold dies and at the same time completing the forming into the complex shape or maintaining that shape.

14 Claims, 1 Drawing Sheet

(51) Int. Cl.

| | |
|---|---|
| ***C22C 21/06*** | (2006.01) |
| ***C22C 21/08*** | (2006.01) |
| ***C22C 21/12*** | (2006.01) |
| ***C22C 21/16*** | (2006.01) |
| ***C22F 1/04*** | (2006.01) |
| ***C22F 1/047*** | (2006.01) |
| ***C22F 1/057*** | (2006.01) |
| *C21D 1/673* | (2006.01) |
| *B21D 22/20* | (2006.01) |

(52) U.S. Cl.
CPC ..... *C22C 21/12* (2013.01); *C22C 21/16* (2013.01); *C22F 1/04* (2013.01); *C22F 1/047* (2013.01); *C22F 1/057* (2013.01); *B21D 22/208* (2013.01); *C21D 1/673* (2013.01)

(58) Field of Classification Search
USPC ..... 72/342.2, 342.3, 342.4, 342.5, 342.7, 72/342.8, 352, 356, 360, 364
See application file for complete search history.

(56) References Cited

U.S. PATENT DOCUMENTS 4,616,499 A * 10/1986 Gray ..... C22F 1/04 72/364
5,019,183 A * 5/1991 Martin ..... 148/564
5,108,519 A * 4/1992 Armanie ..... C22F 1/057 148/697
5,503,692 A * 4/1996 Martin et al. ..... 72/60
5,769,972 A 6/1998 Sun et al.
6,391,127 B1 5/2002 Wyatt-Mair et al.
7,448,528 B2 * 11/2008 Forrest et al. ..... 228/112.1
2002/0170635 A1 * 11/2002 DiSerio ..... 148/552
2004/0221931 A1 * 11/2004 Kotani et al. ..... 148/691
2005/0081965 A1 * 4/2005 Benedictus ..... C22F 1/057 148/552
2010/0012234 A1 * 1/2010 Cantrel et al. ..... 72/360

OTHER PUBLICATIONS

Aerospace Specification Metals Inc., Aluminum 2024-T4; 2024T351, May 15, 2004, www.asm.matweb.com/search/SpecificMaterial.asp?bassnumMA2024T4.*
International Search Report for PCT/GB2010/002100, Completed by the European Patent Office on Mar. 24, 2011, 2 Pages.
Garrett et al. "Soltuion Heat Treatment and Cold Die Quenching in Forming AA6xxx Sheet Components: Feasibility Study", Advanced Materials Research May 2005, vol. 6-8, p. 673-680.
Cassio Barbosa, Non-ferrous metals and their alloys—microstructure, properties and applications, 1st Ed. Rio de Janeiro, May 14, 2014, 3 pages.

* cited by examiner

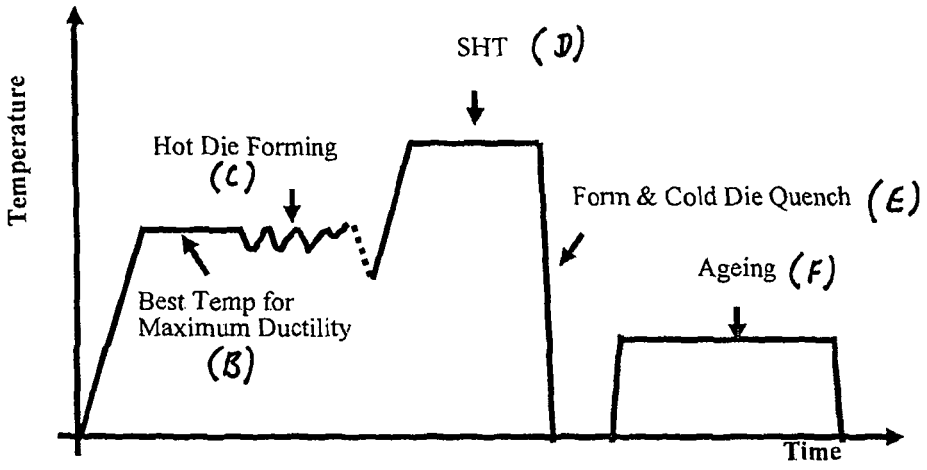
Temperature
SHT (D)
Hot Die Forming
(C)
Form & Cold Die Quench (E)
Ageing (F)
Best Temp for
Maximum Ductility
(B)
Time

METHOD OF FORMING A COMPONENT OF COMPLEX SHAPE FROM SHEET MATERIAL

CROSS-REFERENCE TO RELATED APPLICATION

This application is the U.S. national phase of PCT Appln. No. PCT/GB2010/002100 filed on Nov. 15, 2010, which claims priority to GB Patent Application No. 0919945.6 filed on Nov. 13, 2009, the disclosures of which are incorporated in their entirety by reference herein.

This invention relates to forming components of complex shape from aluminium alloy sheet. This invention also relates to forming such components from magnesium alloy.

BACKGROUND

It is generally desirable that components used in automotive and aerospace applications be made as light as possible. Lighter components contribute to lowering the overall weight of an automobile or aircraft and so assist in improving fuel economy. The use of lightweight components may also provide other advantages such as, in automotive applications, improved handling performance, and, in aerospace applications, allowing a heavier load to be carried. For these reasons, it is desirable to make components for such applications from lightweight alloys, such as aluminium alloys (Al-alloys).

Al-alloys are, however, less ductile than, for example, steel alloys. As a result, it is at least difficult, and sometimes not possible, to form components of complex shape from Al-alloys. Instead, components of complex shape are sometimes milled from solid blocks of heat treated Al-alloy. This can result in a high percentage of the Al-alloy being wasted, and hence in high costs of manufacture. The same is true when forming components from magnesium alloys (Mg-alloys).

WO 2008/059242 discloses a method of forming aluminium alloy (Al-alloy) sheet into components of complex shape. The method disclosed in WO 2008/059242 includes the following general steps:

(i) heating an Al-alloy sheet blank to its solution heat treatment (SHT) temperature and maintaining that temperature until SHT has been completed;

(ii) rapidly transferring the sheet blank to a set of cold dies so that heat loss from the sheet blank is minimised;

(iii) immediately closing the cold dies to form the sheet blank into the component; and (iv) holding the formed component in the closed dies during cooling of the formed component.

Whilst this method has certain advantages over earlier methods, it also has certain drawbacks. For example, the forming needs to be carried out before the sheet cools in order for the method to be successful. As the sheet tends to cool quickly (it is thin and has a low specific heat capacity and high thermal conductivity), the forming must be carried out very quickly. This is problematic in that the forming therefore requires a very quick press with high forming forces. Such presses are expensive and high forming forces tend to shorten tool life. Also, it is difficult to form complex parts: the sheet tends to cool before the complex part can be fully formed.

It is therefore desirable to address this drawback.

SUMMARY

According to a first aspect of this invention, there is provided a method of forming a component of complex shape from an Al-alloy sheet, the method comprising the steps of:

a) heating the sheet to a temperature below the solution heat treatment (SHT) temperature for the alloy;

b) forming the heated sheet between heated dies into or towards the complex shape;

c) heating the sheet to at least its SHT temperature and substantially maintaining that temperature until SHT has been completed; and d) quenching the solution heat treated sheet between cold dies and at the same time completing the forming into the complex shape or maintaining that shape.

It has been found that the formability of Al-alloys is greater at temperatures below the SHT temperature than at the SHT temperature. This is because inclusions in the alloy can become liquid at the SHT temperature and lead to the creation of micro-voids within the material before forming has begun. As a result, formability after SHT, and at the SHT temperature, is reduced.

Thus, by at least partially forming the sheet at a temperature below the SHT temperature, when formability is greater, is easier to form a complex part. This is done in the present method by first heating the sheet to a temperature below the SHT temperature and then forming the sheet at least partly into the complex shape between hot dies. In addition, by placing the at least partly formed sheet between cold dies to quench the sheet, the forming can be finished (or maintained if already fully formed) during the quenching operation, thereby resulting in the component of desired shape.

Step (a) may include heating the sheet to a temperature below that at which inclusions in the alloy melt. Step (a) may include heating the sheet to a temperature at which formability of the alloy is greater than that at the SHT temperature. Step (a) may include heating the sheet to a temperature at which formability of the alloy is substantially maximised.

Step (b) may include forming the sheet in hot dies arranged to minimise heat loss from the sheet. In step (b) the dies may be at a temperature below SHT temperature for the alloy. In step (b) the dies may be at substantially the same temperature as that to which the sheet is heated in step (a). During step (b), the temperature of the dies may be kept substantially constant. The dies of step (b) may comprise one or more heating elements.

Step (d) may include the step of forming holes and or cuts in the sheet. The dies of step (b) may be substantially of the same shape as the die of step (b). The dies of step (b) may be arranged to conduct heat away from the sheet where therein. The dies of step (b) may be cooled; and may comprise one or more cooling elements and/or cooling channels.

The method may include the subsequent step of (e) artificially ageing the resulting component of complex shape.

The Al-alloy may be a 2XXX series Al-alloy, such as AA2024. In step (a), the sheet may be heated to less than 493° C.; the sheet may be heated to less than 470° C.; the sheet may be heated to between 430° C. and 470° C.; the sheet may be heated to between 440° C. and 460° C. Step (a) may comprise heating the sheet to this temperature for between 1 and 10 minutes, or for even longer, before commencing step (b); and may comprise heating the sheet to this temperature for 5 minutes only. Step (c) may comprise heating the sheet to between 490° C. and 495° C., and may comprise heating the sheet to 493° C. Step (c) may comprise heating the sheet to this temperature and substantially maintaining it at this temperature for between 10 and 20 minutes 15 to 20 minutes, before commencing step (d); and may comprise heating the sheet to this temperature and substantially maintaining it at this temperature for between 15 and 20 minutes, such as, for example, for 15 minutes only.

It has been found that the principals of the method of the first aspect can also be used with Mg-alloys.

According to a second aspect of this invention, there is therefore provided a method of forming a component of complex shape from an Al-alloy sheet or a Mg-alloy sheet, the method comprising the steps of:

a) heating the sheet to a temperature below the solution heat treatment (SHT) temperature for the alloy;

b) forming the heated sheet between heated dies into or towards the complex shape;

c) heating the sheet to at least its SHT temperature and substantially maintaining that temperature until SHT has been completed; and d) quenching the solution heat treated sheet between cold dies and at the same time completing the forming into the complex shape or maintaining that shape.

Option features of the first aspect may also be optional features of this second aspect.

Where the method is for forming from a Mg-alloy, the Al-alloy may be an alloy such as AZ31 or AZ91. In step (a), the sheet may be heated to less than 480° C.; the sheet may be heated to less than 470° C.; the sheet may be heated to between 400° C. and 420° C.; the sheet may be heated to approximately 413° C. Step (a) may comprise heating the sheet to this temperature for between 1 and 10 minutes, or for even longer, before commencing step (b); and may comprise heating the sheet to this temperature for 5 minutes only or 3 minutes only. Step (c) may comprise heating the sheet to between 400° C. and 525° C., and may comprise heating the sheet to approximately 480° C. Step (c) may comprise heating the sheet to this temperature and substantially maintaining it at this temperature for between 10 and 20 minutes before commencing step (d); and may comprise heating the sheet to this temperature and substantially maintaining it at this temperature for between 15 and 20 minutes, such as, for example, for 15 minutes only.

The temperature of the cold dies may be less than 50° C.

BRIEF DESCRIPTION OF THE DRAWINGS

Specific embodiments of the invention are described below by way of example only and with reference to the accompanying drawing, in which:

FIG. 1 is a representation of the variation of the temperature of an Al-alloy sheet with time during a method that embodies the invention.

SPECIFIC DESCRIPTION OF CERTAIN EXAMPLE EMBODIMENTS

With reference to FIG. 1, an embodiment of a method of forming a component of complex shape from an Al-alloy sheet will now be described.

A sheet of AA2024 Al-alloy is firstly heated to a temperature of 450° C. in a furnace. This temperature of initial heating is below the typical solution heat treatment (SHT) temperature for AA2024 of 493° C. The sheet is then maintained at 450° C. for five minutes. This part of the method is illustrated by the line B in FIG. 1.

The sheet is then transferred to a set of hot dies. In this embodiment, the dies are maintained at a temperature of below 400° C., specifically, in this embodiment, 350° C. by the operation of heating elements positioned in and around the dies. The sheet is transferred to the hot dies without delay in order to minimise cooling of the sheet during this transfer. The hot dies are then brought together to form the sheet into the shape of the complex component that is to be formed. This part of the method is represented by the line C on FIG. 1. In other embodiments, the hot dies may be such that they form the sheet towards the shape of the complex component such that some subsequent deformation is needed in order finally to achieve that component. This will be explained in more detail below.

Returning to the present embodiment, once the sheet has been formed between the heated dies, it is heated in another furnace to its SHT temperature of 493° C. and maintained at that temperature for 15 minutes such that SHT of the formed sheet is completed. This part of the method is represented by the line D on FIG. 1.

Immediately after the SHT has been completed, the sheet is transferred to cold dies. In this embodiment, the cold dies are of exactly the same shape as the hot dies (although they may differ in other embodiments, as will be described below). The cold dies are then brought together such that the formed sheet is maintained in the shape of the component, or such that the shape is recovered in the event of any distortion thereof during the SHT, and such that the sheet is simultaneously quenched. In this embodiment, the cold dies are maintained at a temperature below 150° C. This is done by the provision of coolant channels in and around the cold dies to convey a coolant therethrough. Once the sheet has been quenched, it is removed from the cold dies. This part of the method is represented by the line E on FIG. 1.

Finally, the sheet, which is now formed into the component of complex shape is artificially aged in a conventional way. This part of the method is represented by the line F on FIG. 1.

It has been found that the formability of AA2024 at its SHT temperature of 293° C. is even lower than its formability at room temperature. Further investigations revealed that this alloy contains large $Al_{20}Cu_2Mn_3$ inclusions which melt at between 470° C. and 480° C. (that is, below the SHT temperature), depending on the heating rate. As a result, these inclusions become liquid at the SHT temperature, which results in the formation of voids in the microstructure of the sheet. This causes the formability to be low. For this reason, the sheet is heated to a temperature below the SHT temperature in the first step of the method. It has been found that AA2024 exhibits maximum formability at 450° C., and so this temperature is used. Similar characteristics have been found in other Al-alloys. In particular, it is envisaged that embodiments of the method may also be used to form components of complex shape from AA5XXX and AA6XXX series alloys, with appropriate changes in temperatures and durations.

Forming the heated sheet between hot dies minimises heat loss from the sheet such that it can be formed at or near isothermal conditions. The forming process need not therefore be carried out as quickly as in WO 2008/059242 or with such large forming forces. Thus, less expensive forming equipment may be used and longer tool life may be expected.

The remainder of the method is similar to that described in WO 2008/059242, but with the exception that no deformation of the sheet is carried out during the quenching between the cold dies (although, in other embodiments, some deformation, such as a small deformation, may occur). The main purposes to this part of the method are to quench the alloy after the SHT and to minimise distortion of the formed component during rapid cooling. In embodiments where further forming is carried out in this part of the method, the shape of the component is further refined into the finished shape and further features of the component may be added.

As already mentioned, in other embodiments, the sheet may not be fully formed into the desired component between the hot dies. Instead, there may be some additional forming between the cold dies. In such embodiments, it is envisaged that the hot and cold dies will not be of exactly the same shape.

As disclosed above, it has also been found that this method works well with Mg-alloys. In a further embodiment, this method is therefore used to form a component of complex shape from Mg-alloy, which in this embodiment is AZ31. The forgoing description of the method described with reference to and shown in FIG. 1 applies, in principal, equally to this embodiment. Certain of the temperatures and durations are, however, varied to take account of the different alloy. These differences are described below.

The sheet of AZ31 is initially heated to 413° C., and maintained at this temperature for approximately 3 minutes. Again, this part of the method is illustrated by line B in FIG. 1. The part of the method illustrated by line C is as before. In the part of the method illustrated by line D, the sheet is heated to its SHT temperature of 480° C. and maintained there for, as before, 15 minutes. The part of the method illustrated by line E is as before, but with the cold dies being maintained below 50° C. Finally, the artificial ageing represented by line F is, as before, done in a conventional way.

The invention claimed is:

1. A method of forming a sheet component of multi-dimensional shape from an Al-alloy or Mg-alloy sheet, the method comprising the following sequence of steps in order:

(a) heating an Al-alloy or Mg-alloy sheet to a temperature below the solution heat treatment (SHT) temperature for the alloy;

(b) forming the heated sheet between heated dies into a shape whilst maintaining the sheet at a temperature below the solution heat treatment (SHT) temperature for the alloy;

(c) solution heat treating the sheet by heating the sheet to its SHT temperature and substantially maintaining that temperature until SHT has been completed; and (d) quenching the solution heat treated sheet between cold dies and at the same time completing the formation of the sheet into a finished shape, wherein step (a) includes either:

heating the Al-alloy sheet to a temperature between 430° C. and 493° C.; or heating the Mg-alloy sheet to a temperature between 400° C. and 480° C.

2. The method according to claim 1, wherein step (a) includes heating the sheet to a temperature below that at which inclusions in the alloy melt.

3. The method according to claim 1, wherein step (a) includes heating the sheet to a temperature at which formability of the alloy is greater than that at the SHT temperature.

4. The method according to claim 1, wherein step (a) includes heating the sheet to a temperature at which formability of the alloy is substantially maximized.

5. The method according to claim 1, wherein step (b) includes forming the sheet in hot dies arranged to minimize heat loss from the sheet.

6. The method according to claim 1, wherein, in step (b), the dies are at substantially the same temperature as that to which the sheet is heated in step (a).

7. The method according to claim 1, wherein, during step (b), the temperature of the dies is kept substantially constant.

8. The method according to claim 1, wherein the dies of step (b) comprise one or more heating elements.

9. The method according to claim 1, wherein the dies of step (d) are cooled.

10. The method according to claim 1, wherein the method includes the subsequent step of (e) artificially ageing the resulting component.

11. The method according to claim 1, wherein the sheet is an AZ31 or AZ91 Mg-alloy.

12. The method according to claim 1, wherein the sheet is a 2XXX series Al-alloy.

13. The method according to claim 12, wherein the 2XXX series Al-alloy is AA2024.

14. The method according to claim 9, wherein the dies of step (d) comprise one or more cooling elements, cooling channels, or both.

* * * * *